US007591272B2

(12) United States Patent
Dastbaz et al.

(10) Patent No.: US 7,591,272 B2
(45) Date of Patent: Sep. 22, 2009

(54) ACIDIC CLEANING COMPOSITION CONTAINING A HYDROPHILIZING POLYMER, A SURFACTANT, AND AN ACID

(75) Inventors: Nathalie Dastbaz, Fleron (BE); Joelle Simon, Stoumont (BE)

(73) Assignee: Colgate-Palmolive Co., New York, NY (US)

( * ) Notice: Subject to any disclaimer, the term of this patent is extended or adjusted under 35 U.S.C. 154(b) by 147 days.

(21) Appl. No.: 11/465,361

(22) Filed: Aug. 17, 2006

(65) Prior Publication Data

US 2007/0105737 A1 May 10, 2007

Related U.S. Application Data

(60) Provisional application No. 60/709,087, filed on Aug. 17, 2005.

(51) Int. Cl.

| | |
|---|---|
| ***B08B 3/04*** | (2006.01) |
| ***C11D 1/00*** | (2006.01) |
| ***C11D 3/37*** | (2006.01) |
| ***C11D 3/43*** | (2006.01) |

(52) U.S. Cl. ..... 134/25.2; 134/25.3; 134/39; 134/42; 510/191; 510/199; 510/238; 510/475; 510/504

(58) Field of Classification Search ..... 510/191, 510/199, 238, 475, 504; 134/25.2, 39, 25.3, 134/42

See application file for complete search history.

(56) References Cited

U.S. PATENT DOCUMENTS

| | | | | |
|---|---|---|---|---|
| 6,025,314 | A | 2/2000 | Nitsch et al. | |
| 6,034,046 | A | 3/2000 | Blanvalet et al. | |
| 6,113,892 | A | 9/2000 | Newell | |
| 6,207,631 | B1 | 3/2001 | Kasturi | |
| 6,221,816 | B1 | 4/2001 | Kasuga | |
| 6,362,148 | B1 | 3/2002 | Durbut | |
| 6,569,261 | B1 | 5/2003 | Aubay | |
| 6,593,288 | B2 | 7/2003 | Aubay et al. | |
| 6,627,590 | B1 * | 9/2003 | Sherry et al. | 510/238 |
| 6,649,580 | B2 | 11/2003 | Aszman et al. | |
| 6,664,218 | B1 | 12/2003 | Dastbaz et al. | |
| 6,924,260 | B2 | 8/2005 | Aubay | |
| 2003/0017960 | A1 | 1/2003 | Bertrem et al. | |
| 2003/0083223 | A1 * | 5/2003 | Aubay et al. | 510/475 |
| 2004/0058847 | A1 | 3/2004 | Morschhauser et al. | |

FOREIGN PATENT DOCUMENTS

| | | | |
|---|---|---|---|
| DE | 195 32 542 | | 3/1997 |
| DE | 100 62 355 | A1 | 6/2001 |
| EP | 0 266 111 | | 5/1988 |
| EP | 0 467 472 | | 1/1992 |
| EP | 0 552 756 | A1 | 7/1993 |
| EP | 0 835 925 | A2 | 4/1998 |
| EP | 0 875 551 | | 11/1998 |
| EP | 0 894 489 | A1 | 2/1999 |
| EP | 1 400 583 | | 3/2004 |
| GB | 2 104 091 | A2 | 3/1983 |
| WO | 9636312 | A1 | 11/1996 |
| WO | 9722640 | A1 | 6/1997 |
| WO | 9956712 | A1 | 11/1999 |
| WO | 0105922 | A1 | 1/2001 |
| WO | WO 01/42415 | | 6/2001 |
| WO | 0176552 | A2 | 10/2001 |
| WO | WO 2005/100523 | | 10/2005 |

OTHER PUBLICATIONS

MERQUAT Polyquaternium 39 Series "Water Soluble Polymers for Personal Care" Data Sheet Apr. 2001.
CAS Registry No. 25136-75-8, Nov. 16, 1984.
File History for EP Application No. 05749688.2 as of May 2009.

* cited by examiner

*Primary Examiner*—Brian P Mruk
(74) *Attorney, Agent, or Firm*—Michael F. Morgan

(57) ABSTRACT

An acidic cleaning composition designed to clean hard surfaces and to prevent soil build-up comprising a hydrophilizing polymer, a surfactant, and an acid and to methods of using the composition to remove limescale and/or soapscum.

12 Claims, No Drawings

ACIDIC CLEANING COMPOSITION CONTAINING A HYDROPHILIZING POLYMER, A SURFACTANT, AND AN ACID

CROSS REFERENCE TO RELATED APPLICATION

This application claims priority to U.S. Provisional Patent Application Ser. No. 60/709,087, filed on Aug. 17, 2005, which is incorporated herein by reference.

BACKGROUND OF THE INVENTION

The use of acidic cleaning compositions for cleaning hard surfaces is known in the patent literature.

The use of sequestering agents or film forming polymers for preventing soil build-up on hard surfaces has been described in the patent literature.

U.S. Pat. No. 6,593,288 for example describes amphoteric polymers for treating a hard surface, which are copolymers formed from two described monomer compounds.

U.S. Pat. No. 6,664,218 describes a cleaning composition containing a hydrophilizing polymer for treating hard surfaces, which is incorporated herein by reference.

However, the problem of providing a cleaning composition which is capable of effecting superior cleaning of lime scale and soap scum from hard surfaces as well as preventing soil build-up of a variety of soils, especially soils normally encountered in the bathroom, remains an unmet need in the prior art.

SUMMARY OF THE INVENTION

A method of removing limescale and soap scum from a surface comprising:

(i) applying a cleaning composition to a surface chosen from a shower, a bath tub, and a sink, and (ii) rinsing the cleaning composition from the surface, wherein the cleaning composition comprises:

(a) a hydrophilizing polymer, (b) a surfactant, and (c) an acid.

A liquid cleaning composition comprising:

(a) a hydrophilizing polymer;

(b) a surfactant;

(c) an acid; and (d) a solvent.

DETAILED DESCRIPTION OF THE INVENTION

As used throughout, ranges are used as a shorthand for describing each and every value that is within the range. Any value within the range can be selected as the terminus of the range.

The present invention relates to hard surface cleaning compositions. In one embodiment, the hard surfaces treated therewith are those located in bathrooms. In one embodiment, the compositions are aqueous compositions comprising a hydrophilizing polymer, a surfactant and an acid.

The hard surface cleaning composition provides enhanced cleaning of acid sensitive stains like lime scale and soap scum in order to facilitate subsequent cleaning.

The Polymer:

A hydrophilizing polymer selected from the range of hydrophilizing polymers produced by Rhodia under the trade name MIRAPOL SURF S™, which are described in WO 01/05921 and U.S. Pat. Nos. 6,593,288; 6,767,410; and 6,924,260 all of which are incorporated herein by reference, or a mixture thereof.

In one embodiment the hydrophilizing polymer is a water soluble or water dispersible copolymer comprising a reaction product of:

(a) at least one monomer having the following structure (I):

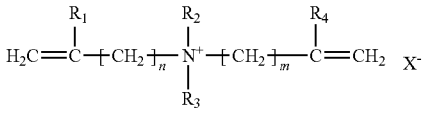

(I)

wherein $R_1$ and $R_4$ independently represent a hydrogen atom or a linear or branched $C_1$-$C_6$ alkyl group;

$R_2$ and $R_3$ independently represent an alkyl, hydroxyalkyl or amino alkyl group in which the alkyl group is a linear or branched $C_1$-$C_6$ chain, in one embodiment they are a methyl group;

n and m represent integers between 1 and 3;

$X^-$ represents a counterion; and (b) at least one hydrophilic monomer having an acidic function which is copolymerizable with (a) and capable of ionizing in the medium of use; and wherein the molar ratio of monomers (a)/(b) is from about 60/40 to about 5/95.

The Surfactant:

The surfactant is selected from the group of zwitterionic, cationic, anionic, nonionic surfactants or a mixture thereof. In some embodiments, the zwitterionic, the non-ionic surfactants, and combinations thereof are used.

Representative of the water-soluble zwitterionic surfactant which is present in the liquid composition is a water soluble betaine having the general formula:

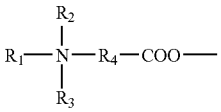

wherein $R_1$ is an alkyl group having 10 to 20 carbon atoms, or 12 to 16 carbon atoms, or the amido radical:

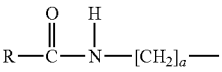

wherein R is an alkyl group having 9 to 19 carbon atoms and a is the integer 1 to 4; $R_2$ and $R_3$ are each alkyl groups having 1 to 3 carbons or 1 carbon; $R_4$ is an alkylene or hydroxyalkylene group having from 1 to 4 carbon atoms and, optionally, one hydroxyl group. Typical alkyldimethyl betaines include decyl dimethyl betaine or 2-(N-decyl-N, N-dimethyl-ammonia) acetate, coco dimethyl betaine or 2-(N-coco N, N-dimethylammonio) acetate, myristyl dimethyl betaine, palmityl dimethyl betaine, lauryl diemethyl betaine, cetyl dimethyl betaine, stearyl dimethyl betaine, etc. The amidobetaines similarly include cocoamidoethylbetaine, cocoamidopropyl betaine and the like. In one embodiment, the betaine is coco ($C_8$-$C_{18}$) amidopropyl dimethyl betaine.

The water soluble nonionic surfactants are commercially well known and include the primary aliphatic alcohol ethoxylates, secondary aliphatic alcohol ethoxylates, alkylphenol ethoxylates and ethylene-oxide-propylene oxide condensates on primary alkanols, such a PLURAFAC™ (BASF) and condensates of ethylene oxide with sorbitan fatty acid esters such as the TWEEN™ (ICI). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water-soluble nonionic detergent. Further, the length of the polyethenoxy chain can be adjusted to achieve the desired balance between the hydrophobic and hydrophilic elements.

The nonionic detergent class includes the condensation products of a higher alcohol (e.g, an alkanol containing about 8 to 18 carbon atoms in a straight or branched chain configuration) condensed with about 5 to 30 moles of ethylene oxide, for example, lauryl or myristyl alcohol condensed with about 16 moles of ethylene oxide (EO), tridecanol condensed with about 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

In one embodiment, the nonionic surfactants are the NEODOL™ ethoxylates (Shell Co.), which are higher aliphatic, primary alcohol containing about 9-15 carbon atoms, such as $C_9$-$C_{11}$ alkanol condensed with 2.5 to 10 moles of ethylene oxide (NEODOL™ 91-2.5 or -5 or -6 or -8), $C_{12-13}$ alkanol condensed with 6.5 moles ethylene oxide (NEODOL™ 23-6.5), $C_{12-15}$ alkanol condensed with 12 moles ethylene oxide (NEODOL™ 25-12), $C_{14-15}$ alkanol condensed with 13 moles ethylene oxide (NEODOL™ 45-13), and the like. In one embodiment, the nonionic surfactant is a mixture of NEODOL™ 91-8 and NEODOL™ 91-2.5 in a 5:1 to 3:1 weight ratio.

In one embodiment, the nonionic system comprises the mixture of a nonionic surfactant formed from a $C_9$-$C_{11}$ alkanol condensed with 2 to 3.5 moles of ethylene oxide ($C_{9-11}$ alcohol EO 2 to 3.5:1) with a nonionic surfactant formed from a $C_9$-$C_{11}$ alkanol condensed with 7 to 9 moles of ethylene oxide ($C_9$-$C_{11}$ alcohol EO 7 to 9:1), wherein the weight ratio of the $C_9$-$C_{11}$ alcohol EO 7 to 9:1 to the $C_9$-$C_{11}$ alcohol EO 2 to 3.5:1 is from 8:1 to 1:1, or 6:1 to 3:1.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$-$C_{15}$ secondary alkanol condensed with either 9 EO (TERGITOL™ 15-S-9) or 12 EO (TERGITOL™ 15-S-12) marketed by Union Carbide.

Other suitable nonionic detergents include the polyethylene oxide condensates of one mole of alkyl phenol containing from about 8 to 18 carbon atoms in a straight- or branched chain alkyl group with about 5 to 30 moles of ethylene oxide. Specific examples of alkyl phenol ethoxylates include nonyl phenol condensed with about 9.5 moles of EO per mole of nonyl phenol, dinonyl phenol condensed with about 12 moles of EO per mole of phenol, dinonyl phenol condensed with about 15 moles of EO per mole of phenol and di-isoctylphenol condensed with about 15 moles of EO per mole of phenol. Commercially available nonionic surfactants of this type include IGEPAL™ CO-630 (nonyl phenol ethoxylate) marketed by GAF Corporation.

Also among the satisfactory nonionic detergents are the water-soluble condensation products of a $C_8$-$C_{20}$ alkanol with a heteric mixture of ethylene oxide and propylene oxide wherein the weight ratio of ethylene oxide to propylene oxide is from 2.5:1 to 4:1, or 2.8:1 to 3.3:1, with the total of the ethylene oxide and propylene oxide (including the terminal ethanol or propanol group) being from 60-85%, or 70-80%, by weight. Such detergents are commercially available from BASF, and in one embodiment, the detergent is a $C_{10}$-$C_{16}$ alkanol condensate with ethylene oxide and propylene oxide, the weight ratio of ethylene oxide to propylene oxide being 3:1 and the total alkoxy content being about 75% by weight.

Condensates of 2 to 30 moles of ethylene oxide with sorbitan mono- and tri-$C_{10}$-$C_{20}$ alkanoic acid esters having a HLB of 8 to 15 also may be employed as the nonionic detergent ingredient in the described composition. These surfactants are well known and are available from Imperial Chemical Industries under the Tween trade name. Suitable surfactants include polyoxyethylene (4) sorbitan monolaurate, polyoxyethylene (4) sorbitan monostearate, polyoxyethylene (20) sorbitan trioleate and polyoxyethylene (20) sorbitan tristearate.

Other suitable water-soluble nonionic detergents are marketed under the trade name PLURONIC™. The compounds are formed by condensing ethylene oxide with a hydrophobic base formed by the condensation of propylene oxide with propylene glycol. The molecular weight of the hydrophobic portion of the molecule is of the order of 950 to 4000, or 200 to 2,500. The addition of polyoxyethylene radicals to the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. In one embodiment, these surfactants will be in liquid form and satisfactory surfactants are available as grades L 62 and L 64.

The Acid:

The liquid compositions of the present invention are acidic. Therefore they have a pH below 7, in some embodiments below about 4 and in some embodiments below about 3. The acids to be used have to be strong enough to lower the pH as desired. They can be organic or inorganic, or a mixture thereof. Representative of the various organic acids are citric acid, lactic acid, maleic acid, malic acid, glycolic acid, succinic acid, glutaric acid, adipic acid and mixture thereof. Representative of the various inorganic acids that can be used are sulphuric acid, sulfamic acid, chlorhydric acid, phosphoric acid, nitric acid and mixture thereof.

Optional Ingredients:

The liquid compositions of the instant invention may include a variety of optional ingredients to deliver additional benefits.

The following are mentioned by way of example:

Solvents: the composition of the instant invention may comprise a solvent or a mixture of solvents. Solvents to be used herein are all those known in the art of hard surface cleaners. In one embodiment, the solvent is at least one of propylene glycol N-butyl ether, ethanol, and/or isopropanol.

Surface protecting agents: in order to protect acid sensitive enamel surfaces, the composition can include a combination of aminophosphonic acid and phosphoric acid.

Colors or dyes in amounts up to 0.5% by weight;

Antioxidizing agents such as 2.6-di-ter.butyl-p-cresol in amounts up to 0.5% by weight.

pH adjusting agents such as citric acid or sodium hydroxide as needed.

Perfume: The composition can optionally contain 0 to 2 wt. %, or 0.1 wt. % to 1.0 wt. % of a perfume. As used herein the term "perfume" is used in its ordinary sense to refer to and include any non-water soluble fragrant substance or mixture of substances including natural (i. e., obtained by extraction of flower, herb, blossom or plant), artificial (i.e., mixture of natural oils or oil constituents) and synthetically produced substance) odoriferous substances. Typically, perfumes are complex mixtures of blends of various organic compounds such as alcohols, aldehydes, ethers, aromatic compounds and varying amounts of essential oils (e.g., terpenes) such as from 0% to 80%, usually from 10% to 70% by weight, the essential oils themselves being volatile odoriferous compounds and also serving to dissolve the other components of the perfume. In the present invention the precise composition of the perfume is of no particular consequence to cleaning performance so long as it meets the criteria of water immiscibility and having a pleasing odor. Naturally, of course, especially for cleaning compositions intended for use in the home, the perfume, as well as all other ingredients, should be cosmetically acceptable, i.e., non-toxic, hypoallergenic, etc.

Preservative: Preservatives can be used in the instant compositions at a concentration of 0.001 wt. % to 3 wt. %, or 0.01 wt. % to 2.5 wt. % are: benzalkonium chloride; benzethonium chloride,5-bromo-5-nitro-1,3dioxane; 2-bromo-2-nitropropane-1,3-diol; alkyl trimethyl ammonium bromide; N-(hydroxymethyl)-N-(1,3-dihydroxy methyl-2,5-dioxo-4-imidaxolidinyl-N'-(hydroxy methyl) urea; 1-3-dimethyol-5,5-dimethyl hydantoin; formaldehyde; iodopropynl butyl carbamata, butyl paraben; ethyl paraben; methyl paraben; propyl paraben, mixture of methyl isothiazolinone/methylchloroisothiazoline in a 1:3 wt. ratio; mixture of phenoxythanol/butyl paraben/methyl paraben/propylparaben; 2-phenoxyethanol; tris-hydroxyethyl-hexahydrotriazine; methylisothiazolinone; 5-chloro-2-methyl-4-isothiazolin-3-one; 1,2-dibromo-2,4-dicyanobutane; 1-(3-chloroalkyl)-3,5,7-triaza-azoniaadamantane chloride; and sodium benzoate.

The compositions of the present invention can be provided in a cleaning wipe in an effective amount.

The following examples illustrate the cleaning compositions of the described invention. The exemplified compositions are illustrative and do not limit the scope of the invention.

Unless otherwise specified, all percentages are by weight.

EXAMPLE

A liquid cleaning composition of the invention B was comprised of the following and compared to a cleaning composition as described in U.S. Pat. No. 6,664,218B1. The compositions were tested and evaluated as bathroom cleaners.

| | A (comparative) | B |
|---|---|---|
| Ingredient | | |
| Mirapol Suf S 210 | 0.5 | 0.5 |
| CAPB (coco amido propyl dimethyl betaine) | 1 | 1 |
| Ethanol | 1.5 | 1.5 |
| PnB | 1.5 | 1.5 |
| Citric acid | — | 3.7 |
| Perfume | 0.15 | 0.15 |
| Water and minors | Up to 100 | Up to 100 |
| pH | 7.5 | 2.1 |

-continued

| | A (comparative) | B |
|---|---|---|
| Performance | | |
| Removes limescale | No | Yes |
| Prevents formation of limescale/watermarks | Yes | Yes |
| Prevents soap scum build-up | Yes | Yes |

The performance of cleaning compositions A and B were evaluated by a test panel. Both compositions A and B prevented the formation of limescale and soap scum. But only composition B of the invention removed limescale from the bathroom hard surfaces.

What is claimed is:

1. A method of removing limescale and soap scum from a surface comprising:

(i) applying a cleaning composition to a surface chosen from a shower, a bath tub, and a sink, and (ii) rinsing the cleaning composition from the surface, thereby cleaning limescale and soap scum from the surface, wherein the cleaning composition is an acidic composition and comprises:

(a) a hydrophilizing polymer comprising a water soluble or water dispersible copolymer comprising a reaction product of:

(I) at least one monomer having the following structure (I):

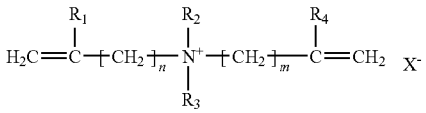

(I)

wherein $R_1$ and $R_4$ independently represent a hydrogen atom or a linear or branched $C_1$-$C_6$ alkyl group;

$R_2$ and $R_3$ independently represent an alkyl, hydroxyalkyl or amino alkyl group in which the alkyl group is a linear or branched $C_1$-$C_6$ chain;

n and m independently represent integers between 1 and 3;

$X^-$ represents a counterion; and (II) at least one hydrophilic monomer having an acidic function which is copolymerizable with (a) and capable of ionizing in the medium of use; and wherein the molar ratio of monomers (a)/(b) is from about 60/40 to about 5/95, (b) a surfactant, (c) an acid, and (d) a solvent comprising propylene glycol N-butyl ether.

2. The method of claim 1, wherein the composition comprises about 0.001% to about 10% by weight of the hydrophilizing polymer.

3. The method of claim 1, wherein the composition comprises about 0.01% to about 2% by weight of the hydrophilizing polymer.

4. The method of claim 1, wherein the composition comprises about 0.01% to about 10% by weight of the surfactant.

5. The method of claim 1, wherein the surfactant comprises a water soluble betaine.

6. The method of claim 1, wherein the surfactant comprises a nonionic surfactant.

7. The method of claim 1, wherein the composition further comprises an additional solvent chosen from glycol ethers, alcohols, and mixtures thereof.

8. The method of claim 7, wherein the additional solvent is chosen from ethanol, isopropanol, and combinations thereof.

9. The method of claim 1, wherein the acid comprises citric acid.

10. The method of claim 1, wherein the composition has a pH below about 4.

11. The method of claim 1, wherein the composition is present in an effective amount in a cleaning wipe.

12. The method of claim 1, wherein the acid comprises lactic acid.

* * * * *